US009144974B2

(12) United States Patent
Suzuki et al.

(10) Patent No.: US 9,144,974 B2
(45) Date of Patent: Sep. 29, 2015

(54) LIQUID JET HEAD AND LIQUID JET RECORDING APPARATUS

(71) Applicant: SII PRINTEK INC., Chiba (JP)

(72) Inventors: Makoto Suzuki, Chiba (JP); Yuzuru Kubota, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 14/149,590

(22) Filed: Jan. 7, 2014

(65) Prior Publication Data

US 2014/0192115 A1 Jul. 10, 2014

(30) Foreign Application Priority Data

Jan. 10, 2013 (JP) ..... 2013-002907

(51) Int. Cl.
*B41J 2/14* (2006.01)
*B41J 2/16* (2006.01)

(52) U.S. Cl.
CPC .... *B41J 2/14209* (2013.01); *B41J 2002/14491* (2013.01)

(58) Field of Classification Search
None
See application file for complete search history.

(56) References Cited

U.S. PATENT DOCUMENTS

2002/0030715 A1 3/2002 Takata et al. ..... 347/37
2004/0141028 A1* 7/2004 Nakamura ..... 347/50
2013/0083128 A1* 4/2013 Watanabe ..... 347/50

FOREIGN PATENT DOCUMENTS

JP 2002321423 11/2002
JP 2004209796 7/2004
JP 2005319817 11/2005

OTHER PUBLICATIONS

IPO Search Report mailed Jul. 10, 2014 issued in Appln. No. GB1400384.2.

* cited by examiner

*Primary Examiner* — Erica Lin
(74) *Attorney, Agent, or Firm* — Adams & Wilks

(57) ABSTRACT

A liquid jet head includes an ejecting portion having a first head chip and a second chip which are laminated with each other, and a circuit board which outputs a drive signal for driving the ejecting portion. A first connection board electrically connects the first head chip to the circuit board, and a second connection board electrically connects the second head chip to the circuit board. A bend portion is provided in the circuit board so that by bending the circuit board at the bend portion, the first electrode terminal portion and the second electrode terminal portion are made to extend in the same direction, and face each other in the lamination direction of the head chips. The circuit board has a connecting terminal that is exposed to the outside through a window in the circuit board when the circuit board is bent at the ending portion.

12 Claims, 10 Drawing Sheets

LIQUID JET HEAD AND LIQUID JET RECORDING APPARATUS

BACKGROUND

1. Technical Field

The present invention relates to a liquid jet head and a liquid jet recording apparatus each of which ejects liquid from a nozzle hole to record an image or a character on a recording medium.

2. Related Art

Conventionally, as an apparatus which jets liquid (ink) onto a recording medium, a liquid jet recording apparatus which jets ink droplets from a plurality of nozzle holes of an ink chamber toward a recording medium has been known. Such a liquid jet recording apparatus includes one that is provided with an ink jet head in which a so-called ink jet method is employed.

A head chip is provided in the ink jet head. The head chip is provided with a piezoelectric actuator on which a plurality of long grooves filled with ink are formed. Electrodes are provided on opposite side walls of each of the long grooves. By applying a predetermined drive voltage to these electrodes, the side walls are deformed, and a capacity inside each of the long grooves changes. As a result, ink droplets are ejected from the nozzle holes toward a recording medium.

Various techniques for increasing the number of nozzle holes have been proposed for the purpose of improving the density of a character or an image recorded on a recording medium. For example, JP 2004-209796 A discloses a technique that enables high density recording by arranging two head chips in a stack to thereby double the number of nozzle holes.

A more detailed description will be made on the basis of FIG. 10.

FIG. 10 is a transverse sectional view of an ink jet head of a conventional example (FIG. 12 of JP 2004-209796 A).

As illustrated in FIG. 10, an ink jet head 110 includes two head chips 101 which are arranged in a stack. Each of the head chips 101 includes a lower substrate 111, an upper substrate 113, a channel portion 115 which is formed between the lower substrate 111 and the upper substrate 113, a nozzle plate 102 which is adhered to the front of the channel portion 115, a wiring board 103 which is adhered to the outer surface of the lower substrate 111, and a driver IC 104 which is mounted on the wiring board 103.

The channel portion 115 is surrounded by the lower substrate 111, the upper substrate 113, and two walls (not shown) which are interposed between the lower substrate 111 and the upper substrate 113 and made of piezoelectric bodies.

The two head chips 101 are laminated with each other in such a manner that the upper substrates 113 of the respective head chips 101 face each other and the lower substrates 111 thereof are located on outer side. The wiring boards 103 are adhered to the outer surfaces of the respective two lower substrates 111. That is, the two head chips 101 are interposed between the two wiring boards 103. The driver ICs 104 are mounted on the inner surfaces of the respective wiring boards 103. Therefore, an area located opposite to the liquid ejection side of the two head chips 101 is surrounded by the two wiring board 103.

Each of the driver ICs 104 mounted on each of the wiring boards 103 inputs therein a control signal from an external circuit such as a control circuit through two connectors 105 and a wiring 106, and generates a drive signal for selectively driving each of the channel portions 115. The drive signal generated by each of the driver ICs 104 is supplied to the corresponding channel portion 115 through a driver wiring 107. The two walls made of piezoelectric bodies are deformed according to the drive signal, which causes the capacity of the channel portion 115 to change. Accordingly, ink filled inside the channel portion 115 is ejected from a nozzle.

Next, another example that enables high density recording will be described on the basis of FIG. 11.

FIG. 11 is a schematic perspective view of a liquid jet head of another conventional example.

As illustrated in FIG. 11, a liquid jet head 120 includes a two-row head chip 123, two circuit boards 124 and 125 which supply a drive signal to the two-row head chip 123, a relay printed circuit board 126 which supplies a control signal to the circuit boards 124 and 125, and four flexible substrates 127, 128, 131, and 132.

The two-row head chip 123 includes two nozzle rows which are formed by adhering together two piezoelectric actuators 121 and 122 which are made of piezoelectric bodies.

In the four flexible substrates 127, 128, 131, and 132, the flexible substrates 127 and 128 are used for electrically connecting the circuit boards 124 and 125 and the two-row head chip 123 to each other. On the other hand, the two flexible substrates 131 and 132 are used for electrically connecting the relay printed circuit board 126 and the two circuit boards 124 and 125 to each other.

The relay printed circuit board 126 is provided with an external device connecting connector 133 which inputs therein a control signal from an external circuit. The relay printed circuit board 126 supplies the input signal to the two circuit boards 124 and 125 through the two flexible substrates 131 and 132.

The two circuit boards 124 and 125 are provided with driver ICs 134 and 135, respectively. Each of the driver ICs 134 and 135 generates a drive signal for driving the two-row head chip 123 according to the input control signal. A drive signal generated by the driver IC 134 is supplied to the upper piezoelectric actuator 121 through the flexible substrate 127. On the other hand, a drive signal generated by the driver IC 135 is supplied to the lower piezoelectric actuator 122 through the flexible substrate 128.

Therefore, the liquid jet head 120 which includes the two-row head chip 123 requires the two circuit boards 124 and 125, the single relay printed circuit board 126, and the four flexible substrates 127, 128, 131, and 132.

In JP 2004-209796 A, the wiring boards 103 are placed on the outside of the lower substrates 111 of the respective head chips 101 so as to largely protrude toward the side opposite to the liquid ejection side. Therefore, the weight of the ink jet head 110 increases, and there is a limit to make the ink jet head 110 thin. In addition, the capacity and the volume of the ink jet head 110 increase. As a result, a carriage and a member of a drive system for driving the carriage become large, thereby disadvantageously increasing the size of the entire apparatus.

Further, disadvantageously, the mass of the carriage which loads thereon a plurality of ink jet heads 110 increases, and a large load is thereby applied on the drive system for driving the carriage.

Further, since the area located opposite to the liquid ejection side of the two head chips 101 is occupied by the wiring boards 103, unfortunately, the area cannot be utilized for another device. In addition, since the two connectors 105 are provided, restriction on the layout of connection between the wirings 106 and an external circuit such as a control circuit disadvantageously increases.

In the conventional example illustrated in FIG. 11, the two circuit boards 124 and 125, the four flexible substrates 127, 128, 131, and 132, and the single relay printed circuit board 126 are placed in an area located opposite to the liquid ejection side. Therefore, unfortunately, there is a limit to reduce the thickness of this area.

Further, the number of components is large, an assembly step for assembling the components becomes complicated and long, and the cause of failure also increases.

SUMMARY OF THE INVENTION

Therefore, the present invention has been made in view of the above situation, and provides a liquid jet head and a liquid jet recording apparatus that are capable of making an area located opposite to the liquid ejection side of a head chip thin and light-weighted and effectively utilizing an arrangement space to improve the layout property of components.

Further, the present invention also provides a liquid jet head and a liquid jet recording apparatus that are capable of improving the assembly workability and reducing the risk of failure.

In order to solve the above problems, a liquid jet head according to the present invention includes an ejecting portion having a first head chip and a second chip for jetting liquid, the first head chip and the second head chip being laminated with each other; a circuit board outputting a drive signal for driving the ejecting portion; a first connection board electrically connecting the first head chip and the circuit board to each other; and a second connection board electrically connecting the second head chip and the circuit board to each other. In the liquid jet head, a first end of the first connection board and a first end of the second connection board are separately formed on any two lateral sides of the circuit board. In the liquid jet head, by bending at least any one of the circuit board, the first connection board and the second connection board at a bend portion provided in at least any one of the circuit board, the first connection board and the second connection board, a second end of the first connection board and a second end of the second connection board are made to extend in the same direction.

In this case, at least any one of the circuit board, the first connection board and the second connection board may be bent at the bend portion. Further, the bend portion may be provided in the circuit board. Further, the circuit board may include a flexible substrate.

Further, the bend portion may be provided in each of the first connection board and the second connection board. Further, each of the first connection board and the second connection board may include a flexible substrate.

With such a configuration, since only the circuit board, the first connection board, and the second connection board are placed in an area located opposite to the liquid ejection side of each of the head chips, the number of components can be reduced. In addition, since the second end of the first connection board and the second end of the second connection board are made to extend in the same direction, the first and second connection boards do not wastefully become long. Therefore, the area located opposite to the liquid ejection side of each of the head chips can be made thin and light-weighted. In addition, it is possible to improve the connection workability between the first and second connection boards and the respective head chips. Further, the number of components can be reduced, and the risk of failure can be reduced.

In the liquid jet head according to the present invention, the circuit board, the first connection board and the second connection board are integrated with each other.

With such a configuration, the number of components can be reduced. Also, the manufacturing cost of the liquid jet head can be reduced.

In the liquid jet head according to the present invention, the second end of the first connection board and the second end of the second connection board face each other in a lamination direction of the first head chip and the second head chip.

With such a configuration, it is possible to further prevent the first and second connection boards from wastefully becoming long, and more reliably make the area located opposite to the liquid ejection side of each of the head chips thin and light-weighted. In addition, it is possible to more reliably improve the connection workability between the first and second connection boards and the respective head chips.

In the liquid jet head according to the present invention, the circuit board includes an external device connecting terminal portion for electrically connecting the circuit board and an external device to each other and a window portion for allowing the external device connecting terminal portion to be exposed to the outside.

In this case, the external device connecting terminal portion may include a flexible substrate, and the flexible substrate may be exposed to the outside through the window portion.

With such a configuration, it is possible to electrically connect the external device and the external device connecting terminal portion to each other through the window portion. In this manner, the arrangement space can be effectively utilized, and the layout property of the liquid jet head can be improved. In addition, downsizing and light-weighting of the liquid jet head can be achieved.

In the liquid jet head according to the present invention, a wiring on the circuit board is laid so as to avoid the window portion.

With such a configuration, it is possible to reliably perform electrical connection between the components mounted on the circuit board.

In the liquid jet head according to the present invention, the window portion is formed opposite to the first connection board and the second connection board across respective electronic elements mounted on the circuit board.

Since the second end of the first connection board and the second end of the second connection board are connected to the respective head chips, the wiring density becomes high near the second end of the first connection board and the second end of the second connection board. Therefore, by forming the window portion so as to be opposite to the first connection board and the second connection board across the respective electronic elements mounted on the circuit board, the wiring layout property can be improved. As a result, the area located opposite to the liquid ejection side of each of the head chips can be made thin and light-weighted.

A liquid jet recording apparatus according to the present invention includes the liquid jet head; a scanning unit moving the liquid jet head; a liquid storage body storing therein liquid; and a liquid supply pipe laid between the liquid jet head and the liquid storage body, the liquid supply pipe allowing the liquid to circulate therethrough.

With such a configuration, it is possible to reduce the drive load of the scanning unit which moves the liquid jet head, and provide the liquid jet recording apparatus with high efficiency and high performance.

According to the present invention, since only the circuit board, the first connection board, and the second connection board are placed in the area located opposite to the liquid ejection side of each of the head chips, the number of components can be reduced. In addition, since the second end of the first connection board and the second end of the second connection board are made to extend in the same direction, the first and second connection boards do not wastefully become long. Therefore, the area located opposite to the liquid ejection side of each of the head chips can be made thin and light-weighted. In addition, it is possible to improve the connection workability between the first and second connection boards and the respective head chips. Further, the number of components can be reduced, and the risk of failure can be reduced.

Further, it is possible to electrically connect the external device and the external device connecting terminal portion to each other through the window portion. In this manner, the arrangement space can be effectively utilized, and the layout property of the liquid jet head can be improved. In addition, downsizing and light-weighting of the liquid jet head can be achieved.

Furthermore, it is possible to reduce the drive load of the scanning unit which moves the liquid jet head, and provide the liquid jet recording apparatus with high efficiency and high performance.

BRIEF DESCRIPTION OF DRAWINGS

FIGS. 5A and 5B illustrate a drive control portion in a second embodiment of the present invention, wherein FIG. 5A is a development perspective view and FIG. 5B is a perspective view illustrating the drive control portion when being assembled to an ejecting portion;

FIGS. 6A and 6B illustrate a drive control portion in a third embodiment of the present invention, wherein FIG. 6A is a development perspective view and FIG. 6B is a perspective view illustrating the drive control portion when being assembled to an ejecting portion;

FIGS. 8A and 8B illustrate a drive control portion in a fifth embodiment of the present invention, wherein FIG. 8A is a development perspective view and FIG. 8B is a perspective view illustrating the drive control portion when being assembled to an ejecting portion;

FIGS. 9A and 9B illustrate a drive control portion in a sixth embodiment of the present invention, wherein FIG. 9A is a development perspective view and FIG. 9B is a perspective view illustrating the drive control portion when being assembled to an ejecting portion;

DETAILED DESCRIPTION

First Embodiment

Liquid Jet Recording Apparatus

Figure 1:
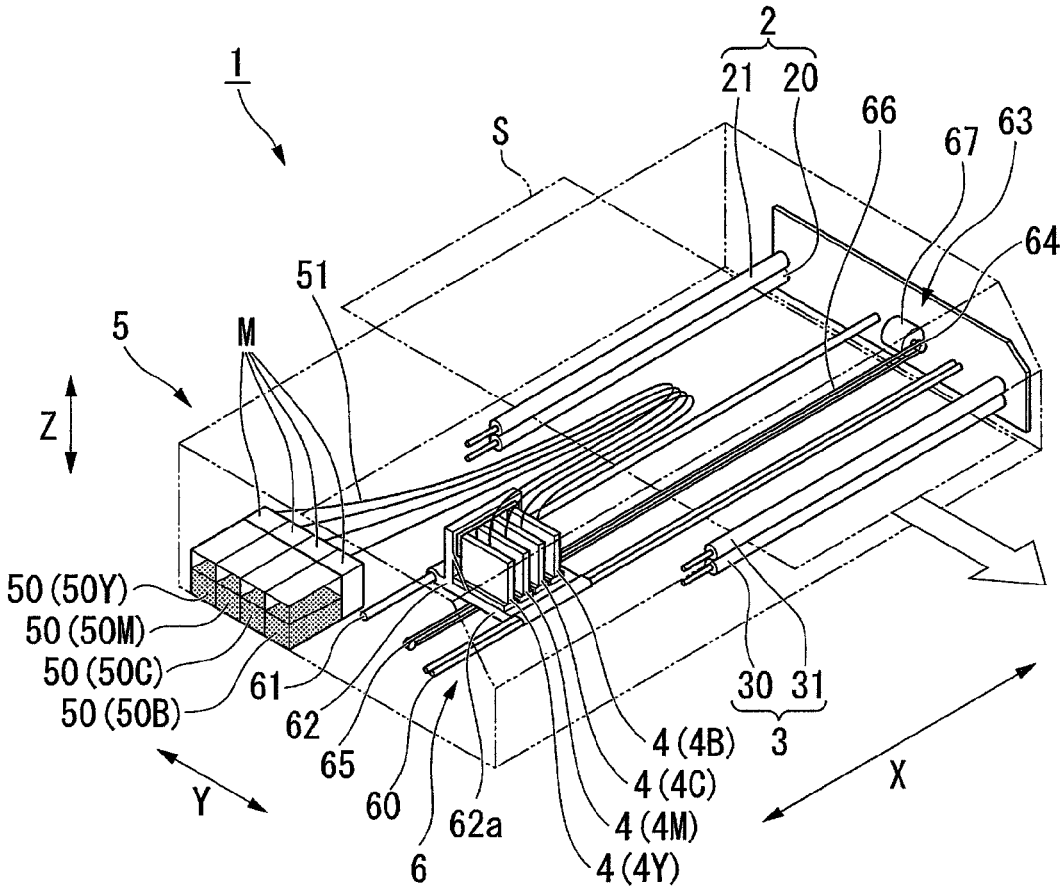
FIG. 1 is a perspective view of a liquid jet recording apparatus in an embodiment of the present invention.

Next, the first embodiment of the present invention will be described on the basis of FIGS. 1 to 4. Note that, in the drawings used in the following description, the scale of each component is appropriately changed so that each component can have a recognizable size.

FIG. 1 is a perspective view of a liquid jet recording apparatus.

The liquid jet recording apparatus 1 is provided with a pair of conveyance mechanisms 2 and 3 which conveys a recording medium S such as paper, a unit head 4 which jets ink droplets onto the recording medium S, a liquid supply unit 5 which supplies ink to the unit head 4, and a scanning unit 6 which moves the unit head 4 in a direction (sub scanning direction) that is perpendicular to a conveyance direction (main scanning direction) of the recording medium S.

In the following description, the sub scanning direction is referred to as an X direction, the main scanning direction is referred to as a Y direction, and a direction that is perpendicular to both of the X direction and the Y direction is referred to as a Z direction. The liquid jet recording apparatus 1 is used with being set in such a manner that the X direction and the Y direction are horizontal and the Z direction is vertical in the gravity direction.

That is, when the liquid jet recording apparatus 1 is in a set state, the unit head 4 moves above the recording medium S along the horizontal direction (X direction and Y direction). Further, ink droplets are jetted from the unit head 4 downward in the gravity direction (downward in the Z direction), and the jetted ink droplets land on the recording medium S.

The conveyance mechanism 2 includes a grid roller 20 which extends in the X direction, a pinch roller 21 which extends in parallel to the grid roller 20, and a drive mechanism (not shown) such as a motor which causes rotational movement of the grid roller 20 about the shaft thereof. Similarly, the conveyance mechanism 3 includes a grid roller 30 which extends in the X direction, a pinch roller 31 which extends in parallel to the grid roller 30, and a drive mechanism (not shown) which causes rotational movement of the grid roller 30 about the shaft thereof.

The liquid supply unit 5 includes a liquid storage body 50 which stores ink therein and a liquid supply pipe 51 which connects the liquid storage body 50 and the unit head 4 to each other. As the liquid storage body 50, for example, a plurality of ink tanks 50Y, 50M, 50C, and 50B which respectively store therein four colors of ink: yellow, magenta, cyan, and black are arranged. Pump motors M are provided in the respective ink tanks 50Y, 50M, 50C, and 50B so that ink can be pressed to move to the unit head 4 through respective liquid supply pipes 51. The liquid supply pipe 51 includes a flexible hose having flexibility that can cope with the operation of the unit head 4 (a carriage unit 62).

The liquid storage body 50 is not limited to the ink tanks 50Y, 50M, 50C, and 50B which respectively store therein four colors of ink: yellow, magenta, cyan, and black, and may be provided with ink tanks which store therein more colors of ink.

The scanning unit 6 includes a pair of guide rails 60 and 61 each of which extends in the X direction, the carriage unit 62 which can slide along the pair of guide rails 60 and 61, and a drive mechanism 63 which moves the carriage unit 62 in the X direction. The drive mechanism 63 includes a pair of pulleys 64 and 65 which are provided between the guide rail 60 and the guide rail 61, an endless belt 66 which is wound around the pair of pulleys 64 and 65, and a drive motor 67 which drives the pulley 64 to rotate.

The pulley 64 is provided between one end of the guide rail 60 and one end of the guide rail 61, and the pulley 65 is provided between the other end of the guide rail 60 and the other end of the guide rail 61. The pulley 64 and the pulley 65 are arranged with a space therebetween in the X direction. The endless belt 66 is provided between the guide rail 60 and the guide rail 61. The carriage unit 62 is coupled to the endless belt 66. The carriage unit 62 loads, on the proximal end 62*a* thereof, a plurality of unit heads 4, specifically, unit heads 4Y, 4M, 4C, and 4B which correspond to four colors of ink: yellow, magenta, cyan and black, respectively, and are arranged in the X direction.

(Unit Head)

Figure 2:
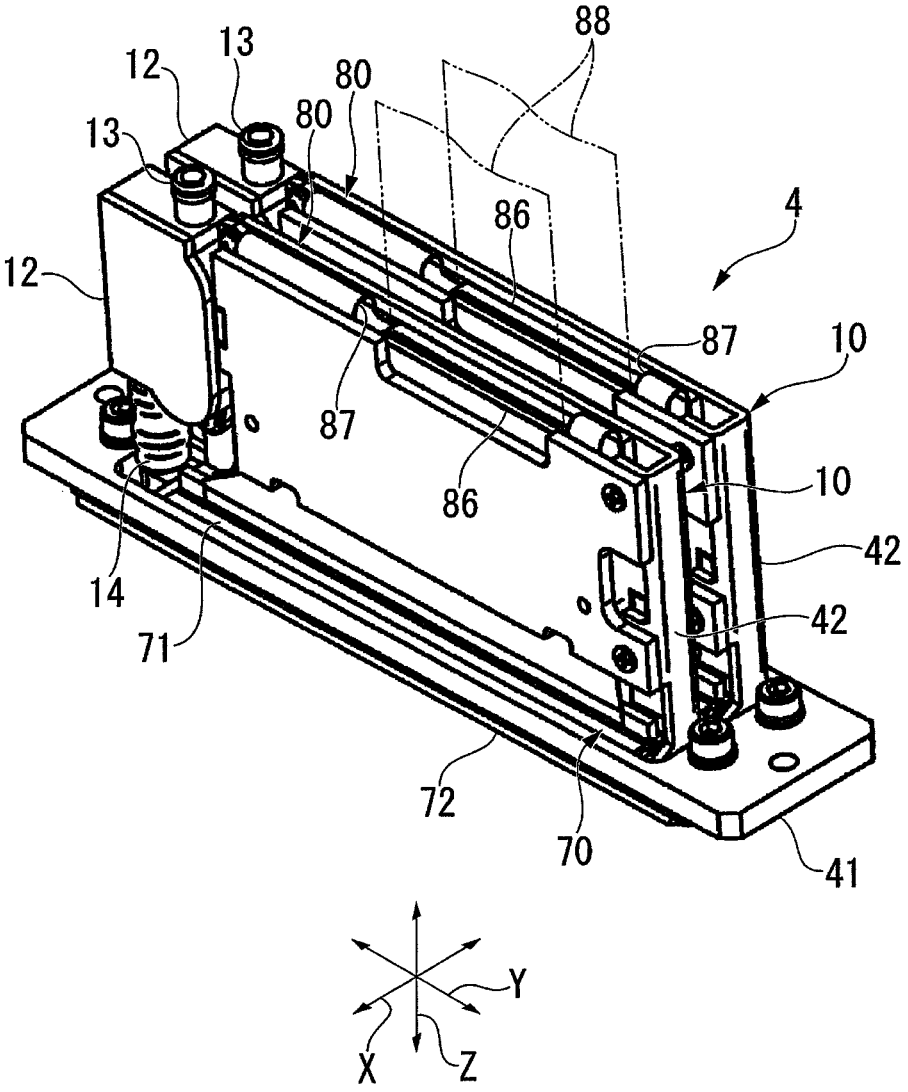
FIG. 2 is a perspective view of a unit head in a first embodiment of the present invention.

FIG. 2 is a perspective view of the unit head.

As illustrated in FIG. 2, the unit head 4 includes a lower base 41 and two liquid jet heads 10 which are arranged on the lower base 41 in two rows. Since the two liquid jet heads 10 have the same configuration, only one of the liquid jet heads 10 will be described in the following description, and a description regarding the other one of the liquid jet heads 10 will be omitted by applying the same reference signs thereto.

(Liquid Jet Head)

The liquid jet head 10 includes an ejecting portion 70 which jets ink droplets to the recording medium S (see FIG. 1), a drive control portion 80 which is electrically connected to the ejecting portion 70 to control the driving of the ejecting portion 70, a vertical base 42 which fixes thereto the drive control portion 80, and a liquid circulation portion 12 which is interposed between the ejecting portion 70 and the liquid supply pipe 51 respectively through a connection portion 13 and a connection portion 14. Ink that flows from the liquid supply pipe 51 passes through the liquid circulation portion 12, and is supplied to the ejecting portion 70. The lower base 41 and the vertical base 42 may be integrally formed.

Figure 3:
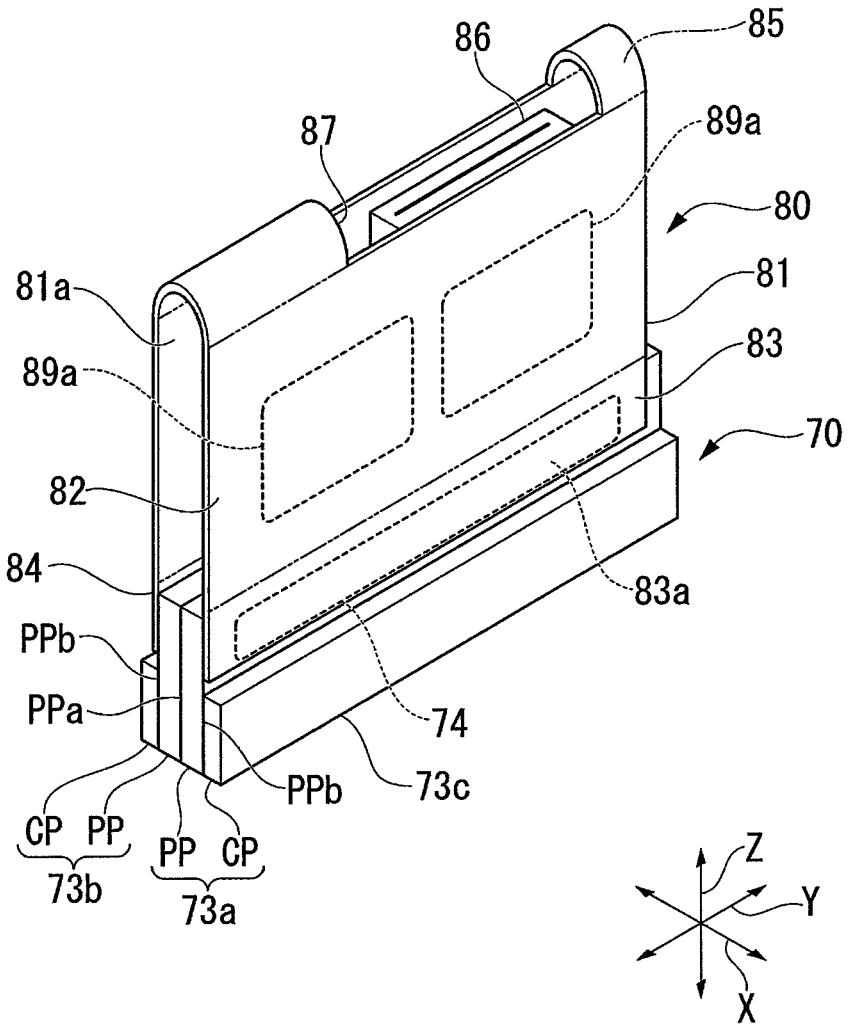
FIG. 3 is a perspective view illustrating an ejecting portion and a drive control portion that are in a connected state in the first embodiment of the present invention.

FIG. 3 is a perspective view illustrating the ejecting portion and the drive control portion that are in a connected state.

As illustrated in FIGS. 2 and 3, the ejecting portion 70 is fixed to the lower base 41, and includes a flow path member 71 which is connected to the liquid circulation portion 12 through the connection portion 14, a first head chip 73*a* and a second head chip 73*b* each of which jets ink as liquid droplets onto the recording medium S when a voltage is applied thereto, and a nozzle plate 72 which is disposed on a lower end surface 73*c* in the Z direction of the first head chip 73*a* and the second head chip 73*b*, namely, on the lowermost surface thereof.

Each of the first head chip 73*a* and the second head chip 73*b* has a laminated structure of a piezoelectric actuator plate PP and a cover plate CP, and is formed into a generally rectangular plate that is long in the Y direction. The first head chip 73*a* and the second head chip 73*b* are arranged in such a manner that the piezoelectric actuator plate PP of the first head chip 73*a* and the piezoelectric actuator plate PP of the second head chip 73*b* overlap with each other in the X direction.

The first head chip 73*a* and the second head chip 73*b* have the same configuration. Therefore, when the configuration of each of the first head chip 73*a* and the second head chip 73*b* is described in the following description, only the configuration of the first head chip 73*a* will be described, and a description regarding the second head chip 73*b* will be omitted by applying the same reference signs thereto.

Further, in the following description, surfaces of the two piezoelectric actuator plates PP, the surfaces overlapping with each other, are referred to as overlapping surfaces PPa, and surfaces opposite to the overlapping surfaces PPa of the two piezoelectric actuator plates PP are referred to as cover surfaces PPb.

The piezoelectric actuator plate PP is a generally rectangular plate which is made of a piezoelectric material such as lead zirconate titanate (PZT). On the cover surface PPb of the piezoelectric actuator plate PP, a plurality of channels (not shown) are formed on the lower side in the Z direction thereof. Each of the channels is to be filled with ink, and formed into a groove that extends in the short side direction of the piezoelectric actuator plate PP (Z direction) and has a generally rectangular cross section.

A plurality of nozzle holes (not shown) which communicate with the respective channels are formed on the nozzle plate 72. The nozzle holes form a nozzle array along the Y direction.

The cover plate CP is laminated on the cover surface PPb of the piezoelectric actuator plate PP. The cover plate CP is formed into a generally rectangular plate that is long in the Y direction so as to close the channels of the piezoelectric actuator plate PP. The flow path member 71 is arranged on a surface of the cover plate CP, the surface not facing the piezoelectric actuator plate PP.

An upper part in the Z direction of the cover surface PPb of the piezoelectric actuator plate PP in which the cover plate CP is not provided is in an exposed state (protruding state), and an electrode extracting portion 74 is formed on this upper part. That is, the electrode extracting portion 74 of the first head chip 73*a* and the electrode extracting portion 74 of the second head chip 73*b* are arranged so as to overlap with each other in the lamination direction of the first head chip 73*a* and the second head chip 73*b* (X direction), and exposed on the outer side in the lamination direction. Further, the drive control portions 80 are connected to the respective electrode extracting portions 74 of the first head chip 73*a* and the second head chip 73*b* each of which is configured in this manner.

Under such a configuration, when a voltage is applied to the piezoelectric actuator plates PP from the drive control portions 80, the channels are deformed. When the channels are deformed, ink filled inside the channels are ejected from the lower end surface 73*c* of the first head chip 73*a* and the second head chip 73*b* through the nozzle plate 72.

As described above, in the liquid jet head 10, the lower end surface 73*c* of the first head chip 73*a* and the second head chip 73*b* is defined as the ink ejection side. The drive control portions 80 are located opposite to the ink ejection side of the first head chip 73*a* and the second head chip 73*b*.

(Drive Control Portion)

Next, the drive control portion 80 will be described in detail on the basis of FIGS. 3 and 4.

Figure 4:
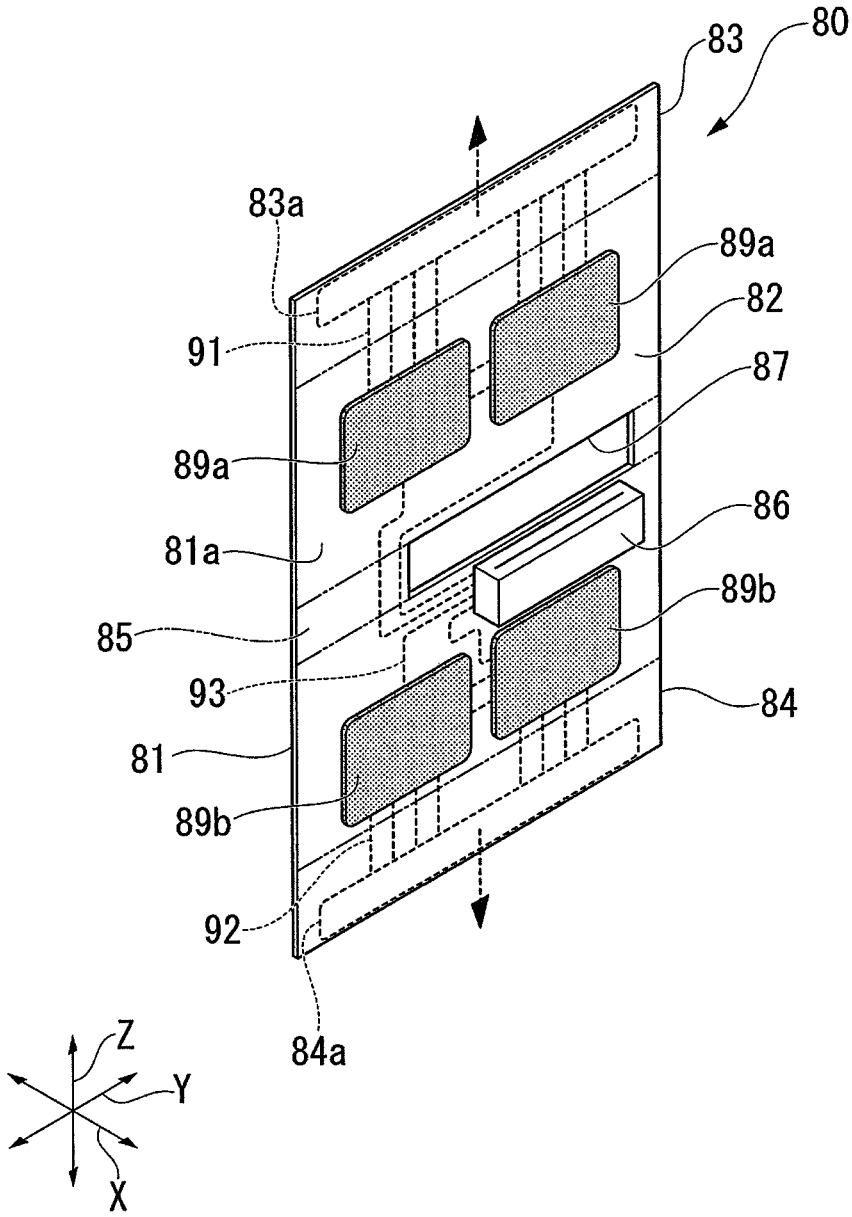
FIG. 4 is a development view of the drive control portion in the first embodiment of the present invention.

FIG. 4 is a development view of the drive control portion.

As illustrated in FIGS. 3 and 4, the drive control portion 80 includes a single flexible substrate 81 having a band shape. A large part on the center in the longitudinal direction of the flexible substrate 81 is configured as a circuit board 82 which outputs a drive signal for driving the ejecting portion 70. A region that extends from a first side of the circuit board 82 is configured as a first connection board 83 for electrically connecting the circuit board 82 and the first head chip 73*a* to each other. On the other hand, a region that extends from a second side of the circuit board 82 is configured as a second connection board 84 for electrically connecting the circuit board 82 and the second head chip 73*b* to each other.

In other words, in the drive control portion 80 of the first embodiment, the first connection board 83 and the second connection board 84 are formed on the respective ends in the Z direction of the circuit board 82 so that the circuit board 82, the first connection board 83 and the second connection board 84 are integrated with each other. In FIGS. 3 and 4, a boundary between the circuit board 82 and the first connection board 83 and a boundary between the circuit board 82 and the second connection board 84 are not clear. However, the both ends in the Z direction of the circuit board 82 correspond to "any two lateral sides of the circuit board" in the claims, which is the same in the following second embodiment and third embodiment.

The first connection board 83 is provided with a first electrode terminal portion 83*a* which is arranged on the edge thereof, the edge not being in contact with the circuit board 82. The first electrode terminal portion 83*a* is provided on a first surface 81*a* of the flexible substrate 81. The first electrode terminal portion 83*a* is used for connecting the first connection board 83 and the electrode extracting portion 74 that is formed on the first head chip 73*a* to each other.

On the other hand, the second connection board 84 is provided with a second electrode terminal portion 84*a* which is arranged on the edge thereof, the edge not being in contact with the circuit board 82. The second electrode terminal portion 84*a* is provided on the first surface 81*a* of the flexible substrate 81 on which the first electrode terminal portion 83*a* is also provided. The second electrode terminal portion 84*a* is used for connecting the second connection board 84 and the electrode extracting portion 74 that is formed on the second head chip 73*b* to each other.

Generally, each of the first electrode terminal portion 83*a* and the second electrode terminal portion 84*a* includes 100 or more electrode terminals. The electrode terminals of the first electrode terminal portion 83*a* are arranged in a line along the short side direction of the flexible substrate 81 (Y direction). Also, the electrode terminals of the second electrode terminal portion 84*a* are arranged in a line along the short side direction of the flexible substrate 81 (Y direction).

The center in the longitudinal direction of the circuit board 82 (Z direction) is configured as a bend portion 85 throughout the short side direction thereof (Y direction). The flexible substrate 81 is bent at the bend portion 85 so that the first electrode terminal portion 83*a* and the second electrode terminal portion 84*a* overlap with each other. As a result, the first connection board 83 and the second connection board 84 are made to extend in the same direction from the circuit board 82 (see FIG. 3).

As illustrated in detail in FIG. 3, the first electrode terminal portion 83*a* of the first connection board 83 and the second electrode terminal portion 84*a* of the second connection board 84 face each other in the X direction. That is, the direction in which the first electrode terminal portion 83*a* and the second electrode terminal portion 84*a* face each other is the same as the lamination direction of the first head chip 73*a* and the second head chip 73*b*.

The circuit board 82 is provided with an external device connecting connector 86 which is arranged on the first surface 81*a* of the flexible substrate 81. A control signal from an external device (not shown) is input to the external device connecting connector 86. The external device connecting connector 86 is arranged so as to be adjacent to the bend portion 85 on the side facing the second connection board 84 as well as so that the longitudinal direction thereof extends along the short side direction of the flexible substrate 81 (Y direction).

The external device connecting connector 86 may be arranged so as to be adjacent to the bend portion 85 on the side facing the first connection board 83 as well as the longitudinal direction thereof extends along the short side direction of the flexible substrate 81 (Y direction).

The bend portion 85 of the circuit board 82 has an opening portion (window portion) 87 which is formed at a position corresponding to the external device connecting connector 86. The opening portion 87 is formed to have a size that is slightly larger than the size of the outer shape of the external device connecting connector 86.

When the circuit board 82 is bent at the bend portion 85, the external device connecting connector 86 is exposed to the outside through the opening portion 87. Further, a flexible flat cable (FFC) 88 (see FIG. 2) which extends from the external device (not shown) is connected to the external device connecting connector 86 through the opening portion 87.

The circuit board 82 is provided with a first driver IC 89*a* which is arranged at a position that is shifted from the bend portion 85 toward the first connection board 83 on the first surface 81*a* of the flexible substrate 81. The circuit board 82 is also provided with a second driver IC 89*b* which is arranged at a position that is shifted from the bend portion 85 toward the second connection board 84 on the first surface 81*a* of the flexible substrate 81. The first driver IC 89*a* generates a drive signal for driving the first head chip 73*a*, and the second driver IC 89*b* generates a drive signal for driving the second head chip 73*b*.

The first driver IC 89*a* and the first electrode terminal portion 83*a* are electrically connected to each other by a wiring 91 which is laid on the flexible substrate 81. The second driver IC 89*b* and the second electrode terminal portion 84*a* are electrically connected to each other by a wiring 92 which is laid on the flexible substrate 81. The first driver IC 89*a*, the second driver IC 89*b*, and the external device connecting connector 86 are electrically connected to each other by a wiring 93 which is laid on the flexible substrate 81. The wiring 93 is laid so as to avoid the opening portion 87.

Under such a configuration, in order to connect the drive control portion 80 to the first head chip 73*a* and the second head chip 73*b* of the ejecting portion 70, the circuit board 82 is first bent at the bend portion 85. Then, with the first electrode terminal portion 83*a* of the first connection board 83 facing the second electrode terminal portion 84*a* of the second connection board 84, the first electrode terminal portion 83*a* is placed on the electrode extracting portion 74 of the first head chip 73*a*, and the second electrode terminal portion 84*a* is placed on the electrode extracting portion 74 of the second head chip 73*b*. Thereafter, the first electrode terminal portion 83*a* is crimp-connected to the electrode extracting portion 74 of the first head chip 73*a*, and the second electrode terminal portion 84*a* is crimp-connected to the electrode extracting portion 74 of the second head chip 73*b*.

The electrode extracting portion 74 of the first head chip 73*a* and the electrode extracting portion 74 of the second head chip 73*b* are arranged so as to overlap with each other in the lamination direction (X direction) of the first head chip 73*a* and the second head chip 73*b*. Therefore, it is possible to apply pressing force onto the first electrode terminal portion 83*a* and the second electrode terminal portion 84*a* at the same time to crimp-connect the first electrode terminal portion 83*a* and the second electrode terminal portion 84*a* to the respective corresponding electrode extracting portions 74 at the same time. In this manner, an operation for electrically connecting the drive control portion 80 to the ejecting portion 70 is completed.

After connecting the drive control portion 80 to the ejecting portion 70, as illustrated in FIG. 2, the ejecting portion 70 is fixed to the lower base 41 and the drive control portion 80 is fixed to the vertical base 42. In the liquid jet head 10 in this state, the lower end surface 73*c* is located on the lower side in the Z direction of the first head chip 73*a* and the second head chip 73*b* of the ejecting portion 70, and the opening portion 87 of the drive control portion 80 is located on the upper side that is opposite to the ejecting portion 70. Further, the external device connecting connector 86 is in an exposed state through the opening portion 87. Therefore, the flexible flat cable (FFC) 88 which extends from the external device (not shown)

can be easily connected to the external device connecting connector 86. In this manner, an operation for electrically connecting the liquid jet head 10 and the external device (not shown) to each other is completed.

(Effect)

Therefore, according to the first embodiment, since only the circuit board 82, the first connection board 83, and the second connection board 84 which constitute the drive control portion 80 are placed in an area located opposite to the lower end surface 73*c* of the first head chip 73*a* and the second head chip 73*b* (ink ejection side), the number of components can be reduced. In addition, since the circuit board 82, the first connection board 83, and the second connection board 84 are formed of the single flexible substrate 81, that is, the circuit board 82, the first connection board 83, and the second connection board 84 are integrated with each other, the number of components can be further reduced. Therefore, the area located opposite to the lower end surface 73*c* of the first head chip 73*a* and the second head chip 73*b* can be made thin and light-weighted. In addition, the risk of failure of the components can be reduced. Further, it is possible to reduce the drive load of the scanning unit 6, and provide the liquid jet recording apparatus 1 with high efficiency and high performance.

Further, by setting the bend portion 85 on the circuit board 82, and bending the circuit board 82 at the bend portion 85, the first electrode terminal portion 83*a* of the first connection board 83 and the second electrode terminal portion 84*a* of the second connection board 84 are made to extend in the same direction. In addition, the first electrode terminal portion 83*a* and the second electrode terminal portion 84*a* are made to face each other in the direction that is the same as the lamination direction of the first head chip 73*a* and the second head chip 73*b*.

Therefore, the thickness of the area located opposite to the lower end surface 73*c* of the first head chip 73*a* and the second head chip 73*b* can be easily reduced. In addition, since the first electrode terminal portion 83*a* and the second electrode terminal portion 84*a* can be crimp-connected to the respective corresponding electrode extracting portions 74 at the same time, the connection workability can be improved. Further, a distance of the layout of the connection boards 83 and 84 does not wastefully become long in comparison with the case where the connection boards 83 and 84 are not made to extend in the same direction. Therefore, downsizing and light-weighting of the entire drive control portion 80 can be achieved.

The circuit board 82 is provided with the external device connecting connector 86 which is arranged adjacent to the bend portion 85 on the side facing the second connection board 84 and the opening portion 87 which is formed on the bend portion 85 at the position corresponding to the external device connecting connector 86. Therefore, when the circuit board 82 is bent at the bend portion 85, the external device connecting connector 86 can be exposed to the outside through the opening portion 87.

Accordingly, it is possible to easily connect the flexible flat cable 88 to the external device connecting connector 86. In addition, a space occupied by the drive control portion 80 can be minimized, and the liquid jet head 10 can be downsized and light-weighted. As a result, the arrangement space can be effectively utilized, and the layout property of the liquid jet head 10 can be improved.

The wiring 93 which electrically connects the first driver IC 89*a*, the second driver IC 89*b*, and the external device connecting connector 86 all of which are disposed on the circuit board 82 to each other is laid so as to avoid the opening portion 87. Further, the wiring 91 which electrically connects the first driver IC 89*a* and the first electrode terminal portion 83*a* to each other is laid opposite to the opening portion 87 across the first driver IC 89*a*, and the wiring 92 which electrically connects the second driver IC 89*b* and the second electrode terminal portion 84*a* to each other is laid opposite to the opening portion 87 across the second driver IC 89*b*. Therefore, the wiring 91 and the wiring 92 can also be regarded as being laid so as to avoid the opening portion 87. Since the wirings 91 to 93 are laid so as to avoid the opening portion 87 in this manner, the respective electrical connections between the first driver IC 89*a*, the second driver IC 89*b*, and the external device connecting connector 86 can be reliably performed.

Generally, each of the first electrode terminal portion 83*a* and the second electrode terminal portion 84*a* includes 100 or more electrode terminals. Therefore, a large number of wirings 91 are laid between the first driver IC 89*a* and the first electrode terminal portion 83*a*, and a large number of wirings 92 are laid between the second driver IC 89*b* and the second electrode terminal portion 84*a*. In such a state, the opening portion 87 is formed in an area in which the wirings 91 and 92 are not laid. Therefore, it is not necessary to lay the large number of wirings 91 and 92 so as to avoid the opening portion 87. As a result, the size of each of the first connection board 83 and the second connection board 84 does not increase.

More specifically, for example, when the opening portion 87 is formed either between the first driver IC 89*a* and the first electrode terminal portion 83*a* or between the second driver IC 89*b* and the second electrode terminal portion 84*a*, it is necessary to ensure a space for laying the wiring 91 or 92 so as to avoid the opening portion 87. Therefore, in this case, the size of a space between the first driver IC 89*a* and the first electrode terminal portion 83*a* or a space between the second driver IC 89*b* and the second electrode terminal portion 84*a* increases. However, since the opening portion 87 is formed on the flexible substrate 81 in an area in which the wirings 91 and 92 are not laid, it is possible to prevent an increase in the size of each of the first connection board 83 and the second connection board 84. As a result, the area located opposite to the lower end surface 73*c* of the first head chip 73*a* and the second head chip 73*b* can be made thinner and more light-weighted.

In the present embodiment, the connector 86 is described as a single connector. However, the connector 86 is not limited thereto, and a plurality of connectors 86*a* and 86*b* (not shown) may be used. In this case, the connector 86*a* is connected to the first driver IC 89*a* through a wiring 93*a* (not shown). Further, the connector 86*b* is connected to the second driver IC 89*b* through a wiring 93*b* (not shown).

By employing such a configuration, a distance in which the wiring 93 is pulled around can be reduced. In addition, it is not necessary to pull around the wiring 93 on a region just beside the opening portion 87 in the Y direction. As a result, the width in the Y direction of the flexible substrate 81 can be further reduced. Therefore, the flexible substrate 81 can be further downsized. In other words, no wiring exists in the bend portion 85 in this configuration. In this case, even if the bend portion 85 is deteriorated with the lapse of time, and a crack is thereby formed on the bend portion 85 of the flexible substrate 81, the wirings are not cut.

Second Embodiment

Next, the second embodiment of the present invention will be described with reference to FIG. 1 and on the basis of FIGS. 5A and 5B. The same aspects as those of the first embodiment will be described by applying the same reference sings thereto (also in all of the following embodiments).

Figure 5A:
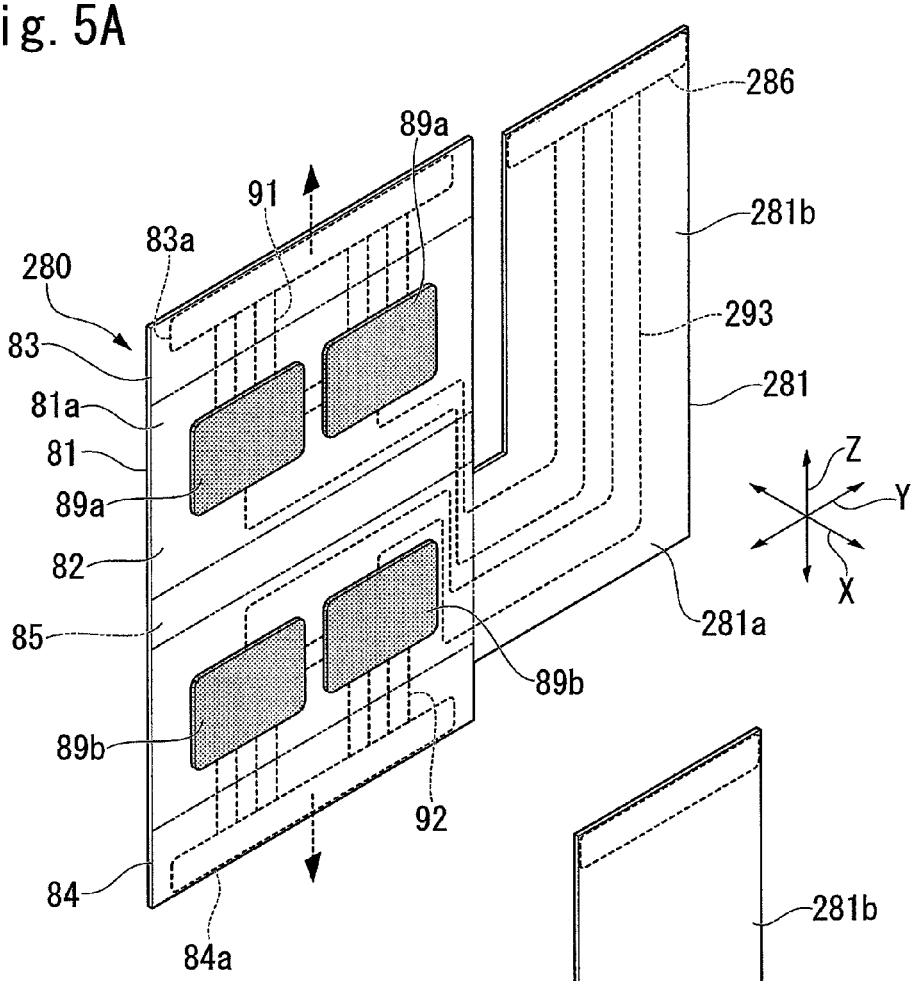
Figure 5B:
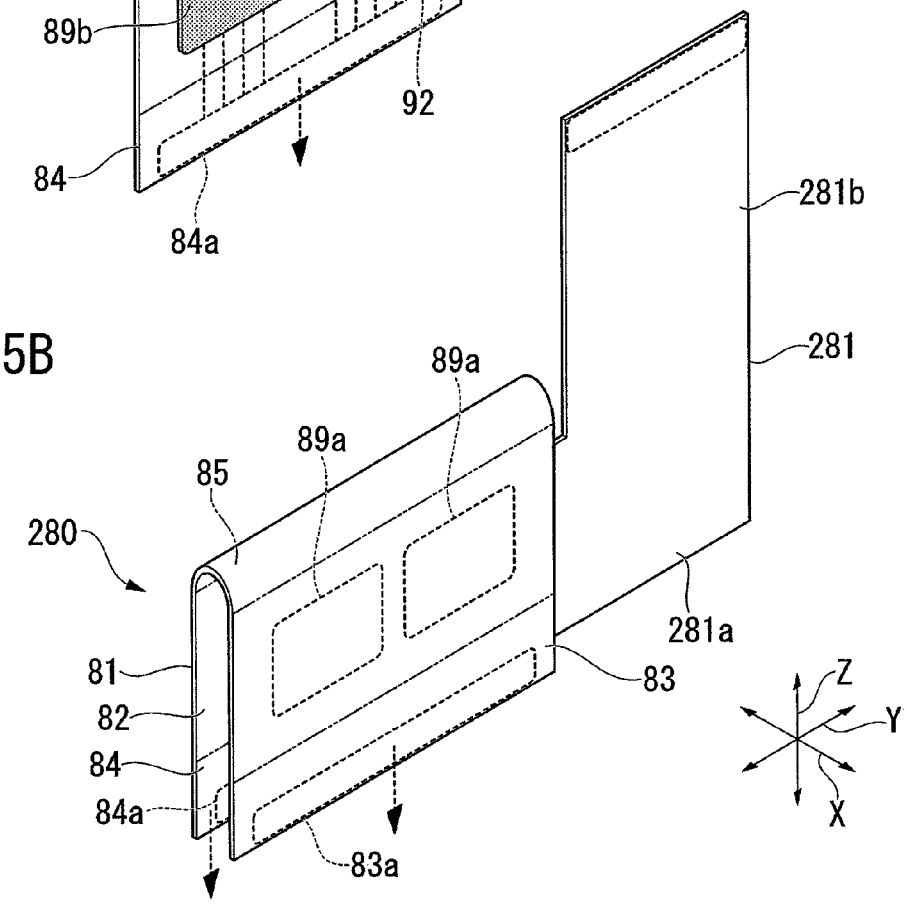

FIGS. 5A and 5B illustrate a drive control portion in the second embodiment. FIG. 5A is a development perspective view, and FIG. 5B is a perspective view illustrating the drive control portion when being assembled to an ejecting portion.

In the second embodiment, a liquid jet recording apparatus 1 is provided with a pair of conveyance mechanisms 2 and 3 which conveys a recording medium S such as paper, a unit head 4 which jets ink droplets onto the recording medium S, a liquid supply unit 5 which supplies ink to the unit head 4, and a scanning unit 6 which moves the unit head 4 in a direction (sub scanning direction) that is perpendicular to a conveyance direction (main scanning direction) of the recording medium S in the same manner as in the first embodiment. Further, when the liquid jet recording apparatus 1 is in a set state, the unit head 4 moves above the recording medium S along the horizontal direction (X direction and Y direction) in the same manner as in the first embodiment.

Further, ink droplets are jetted from the unit head 4 downward in the gravity direction (downward in the Z direction), and the jetted ink droplets land on the recording medium S in the same manner as in the first embodiment. Further, the unit head 4 includes a lower base 41 and two liquid jet heads 10 which are arranged on the lower base 41 in two rows in the same manner as in the first embodiment. Further, the liquid jet head 10 includes an ejecting portion 70 which jets ink droplets to the recording medium S (see FIG. 1), a drive control portion 280 which is electrically connected to the ejecting portion 70 to control the driving of the ejecting portion 70, a vertical base 42 which fixes thereto the drive control portion 280, and a liquid circulation portion 12 which is interposed between the ejecting portion 70 and the liquid supply pipe 51 respectively through a connection portion 13 and a connection portion 14 in the same manner as in the first embodiment. The same configurations are also applied to the following embodiments.

A difference between the first embodiment and the second embodiment is that the external device connecting connector 86 is provided on the circuit board 82 in the drive control portion 80 of the first embodiment, but, on the other hand, an external device connecting terminal 286 is provided on the lateral side in the short side direction of the flexible substrate 81 in the drive control portion 280 of the second embodiment. More details will be described below.

(Drive Control Portion)

As illustrated in FIG. 5A, the drive control portion 280 includes a single flexible substrate 81 having a band shape. A large part on the center in the longitudinal direction of the flexible substrate 81 is configured as a circuit board 82. A region that extends from a first side of the circuit board 82 is configured as a first connection board 83. On the other hand, a region that extends from a second side of the circuit board 82 is configured as a second connection board 84. The configuration of each of the first connection board 83 and the second connection board 84 is the same as that in the drive control portion 80 of the first embodiment.

An external device connecting flexible substrate 281 (hereinbelow, referred to as the external device connecting FPC 281) is integrally formed with the flexible substrate 81 on a first side in the short side direction thereof. The external device connecting FPC 281 is formed into a generally L-shape in a plan view, and includes a short piece FPC 281*a* which extends from the first side in the short side direction (Y direction) of the flexible substrate 81 along the short side direction and a long piece FPC 281*b* which extends from the distal end of the short piece FPC 281*a* along the longitudinal direction (Z direction).

The short piece FPC 281*a* extends from the first side in the short side direction of the flexible substrate 81 at a position that is shifted from the bend portion 85 toward the second connection board 84 within a region corresponding to the circuit board 82 of the flexible substrate 81. The long piece FPC 281*b* is formed so as to extend from the short piece FPC 281*a* in a direction that is the same as the extending direction of the first connection board 83. The external device connecting terminal 286 is formed on the distal end of the long piece FPC 281*b*. The external device connecting terminal 286 is arranged in such a manner that the longitudinal direction thereof extends along the short side direction of the long piece FPC 281*b* (Y direction).

A first driver IC 89*a* and a first electrode terminal portion 83*a* are electrically connected to each other by a wiring 91 which is laid on the flexible substrate 81. A second driver IC 89*b* and a second electrode terminal portion 84*a* are electrically connected to each other by a wiring 92 which is laid on the flexible substrate 81. The first driver IC 89*a*, the second driver IC 89*b*, and the external device connecting terminal 286 are electrically connected to each other by a wiring 293 which is laid on the flexible substrate 81 and the external device connecting FPC 281.

Under such a configuration, as illustrated in FIG. 5B, by bending the circuit board 82 at a bend portion 85 which is set on the circuit board 82, the first electrode terminal portion 83*a* of the first connection board 83 and the second electrode terminal portion 84*a* of the second connection board 84 are made to extend in the same direction. In addition, the first electrode terminal portion 83*a* and the second electrode terminal portion 84*a* are made to face each other in the direction that is the same as the lamination direction of the first head chip 73*a* and the second head chip 73*b* (X direction, see FIG. 3).

Further, the first electrode terminal portion 83*a* is connected to the electrode extracting portion 74 of the first head chip 73*a*, and the second electrode terminal portion 84*a* is connected to the electrode extracting portion 74 of the second head chip 73*b*.

Therefore, according to the second embodiment, the same effect as that of the first embodiment can be achieved. In addition, since the external device connecting terminal 286 is positioned out of the flexible substrate 81 by virtue of the external device connecting FPC 281, it is possible to improve the connection workability between the external device connecting terminal 286 and a flexible flat cable 88 that extends from an external device (not shown).

Third Embodiment

Next, the third embodiment of the present invention will be described on the basis of FIGS. 6A and 6B.

Figure 6A:
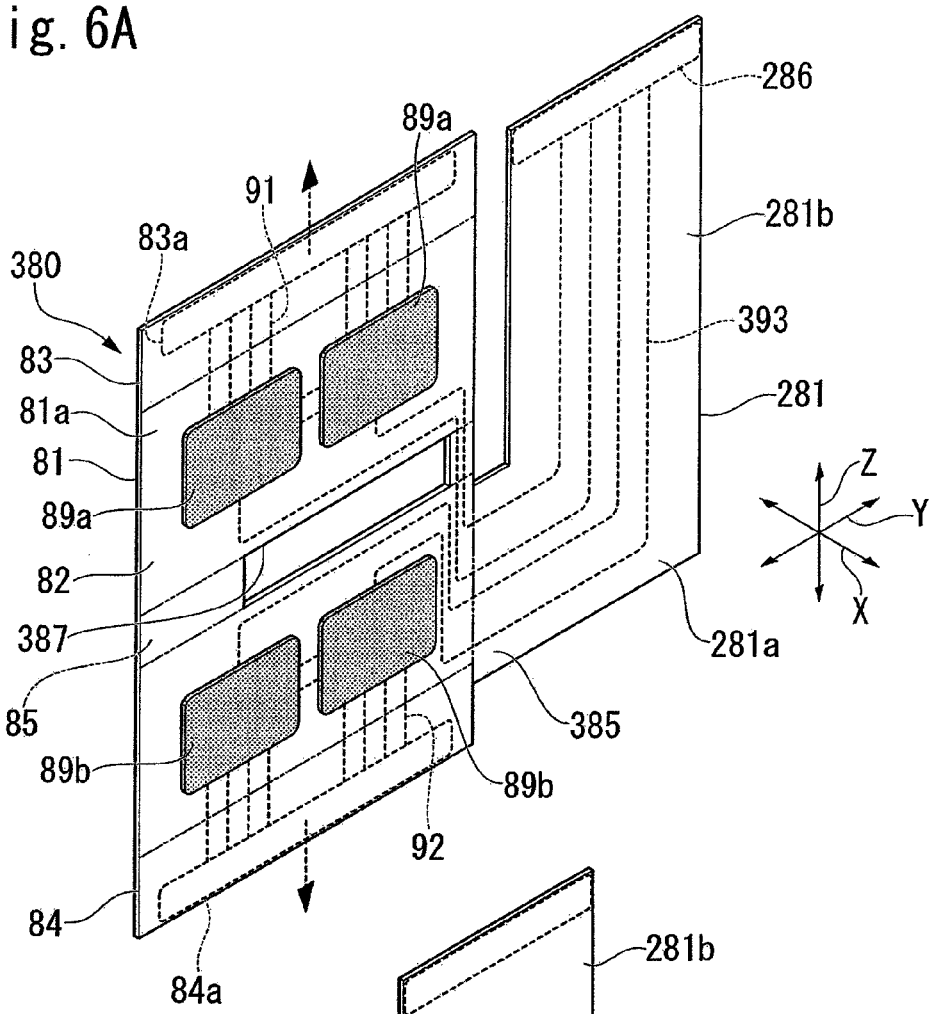
Figure 6B:
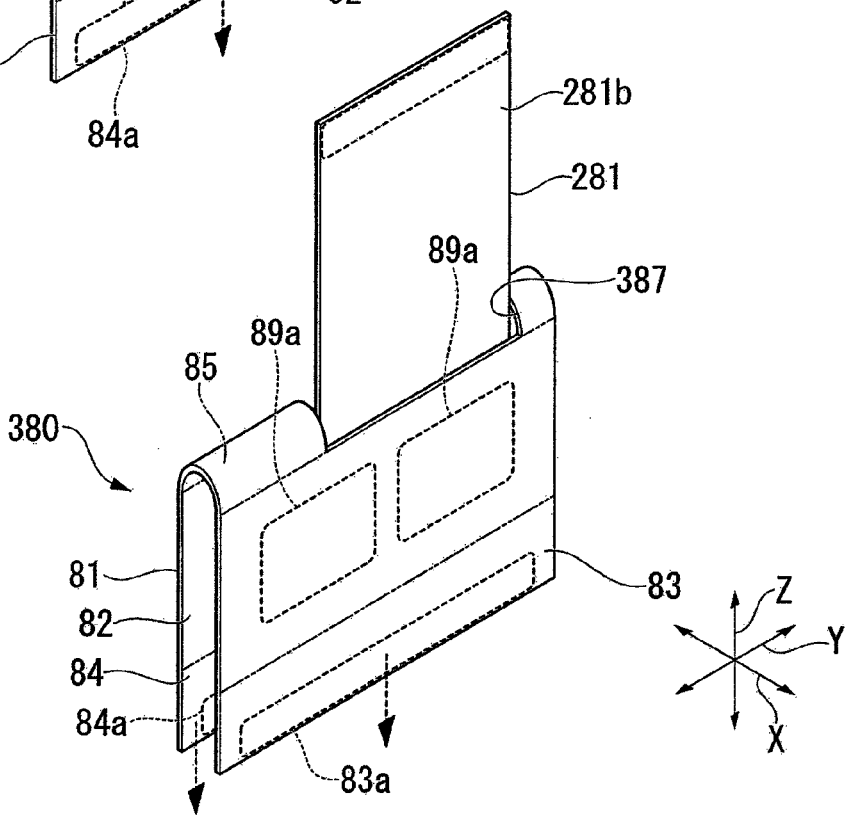

FIGS. 6A and 6B illustrate a drive control portion in the third embodiment. FIG. 6A is a development perspective view, and FIG. 6B is a perspective view illustrating the drive control portion when being assembled to an ejecting portion. FIGS. 6A and 6B correspond to FIGS. 5A and 5B, respectively.

As illustrated in FIG. 6A, a difference between the second embodiment and the third embodiment is that an opening portion (window portion) 387 is not formed on the circuit board 82 in the drive control portion 280 of the second embodiment, but, on the other hand, an opening portion 387 is formed on the circuit board 82 in a drive control portion 380 of the third embodiment.

The opening portion 387 is arranged on the bend portion 85 of the circuit board 82 at a position that is shifted from the center in the short side direction thereof (Y direction) toward the side to which the external device connecting FPC 281 is connected. The opening portion 387 is formed to have a size that is slightly larger than the size of the outer shape of the transverse section of the long piece FPC 281*b*.

Further, a part of the short piece FPC 281*a* of the external device connecting FPC 281, the part being connected to the flexible substrate 81, namely, the base part of the short piece FPC 281*a* is configured as a bend portion 385 throughout the Z direction. A wiring 393 which electrically connects the first driver IC 89*a*, the second driver IC 89*b*, and the external device connecting terminal 286 to each other is laid so as to avoid the opening portion 387.

Under such a configuration, as illustrated in FIG. 6B, in order to connect the drive control portion 380 to the ejecting portion 70 (see FIG. 3), the external device connecting FPC 281 is first bent at the bend portion 385 toward the flexible substrate 81. Then, the circuit board 82 is bent at the bend portion 85. At this point, the long piece FPC 281*b* of the external device connecting FPC 281 is passed through the opening portion 387. That is, the opening portion 387 is formed at a position that corresponds to the position of the long piece FPC 281*b* when the external device connecting FPC 281 is bent at the bend portion 385.

Then, in such a state, the first electrode terminal portion 83*a* is connected to the electrode extracting portion 74 of the first head chip 73*a*, and the second electrode terminal portion 84*a* is connected to the electrode extracting portion 74 of the second head chip 73*b*.

Therefore, according to the third embodiment, the drive control portion 380 can be downsized by bending the external device connecting FPC 281 at the bend portion 385 in addition to the same effect as that of the second embodiment.

In the third embodiment, there has been described the case in which the opening portion 387 is formed at the position that corresponds to the position of the long piece FPC 281*b* when the external device connecting FPC 281 is bent at the bend portion 385, namely, the position that is shifted from the center in the short side direction (Y direction) on the bend portion 85 of the circuit board 82 toward the side to which the external device connecting FPC 281 is connected.

However, the present invention is not limited thereto. The short piece FPC 281*a* of the external device connecting FPC 281 may be formed to be longer, and the opening portion 387 may be formed at a position closer to the center in the short side direction of the circuit board 82 according to the length of the short piece FPC 281*a*.

When the forming position of the opening portion 387 is set at the position that is shifted from the center in the short side direction (Y direction) on the bend portion 85 of the circuit board 82 toward the side to which the external device connecting FPC 281 is connected, it is difficult to lay the wiring 393 between the circuit board 82 and the external device connecting FPC 281. Therefore, it is necessary to lay the wiring 393 by diverting the wiring 393 around the opening portion 387 toward the side opposite to the external device connecting FPC 281. As a result, the laying length of the wiring 393 may become long.

However, when a large space can be ensured between the opening portion 387 and the external device connecting FPC 281, the wiring 393 can be laid on this space. Therefore, it is possible to reduce the laying length of the wiring 393.

It is needless to say that the material cost of the external device connecting FPC 281 can be reduced by shortening the short piece FPC 281*a* of the external device connecting FPC 281 as far as possible. Therefore, it is desired to determine the forming position of the opening portion 387 by taking the material cost of the external device connecting FPC 281 and the linear material cost of the wiring 393 into consideration.

Fourth Embodiment

Next, the fourth embodiment of the present invention will be described on the basis of FIG. 7.

Figure 7:
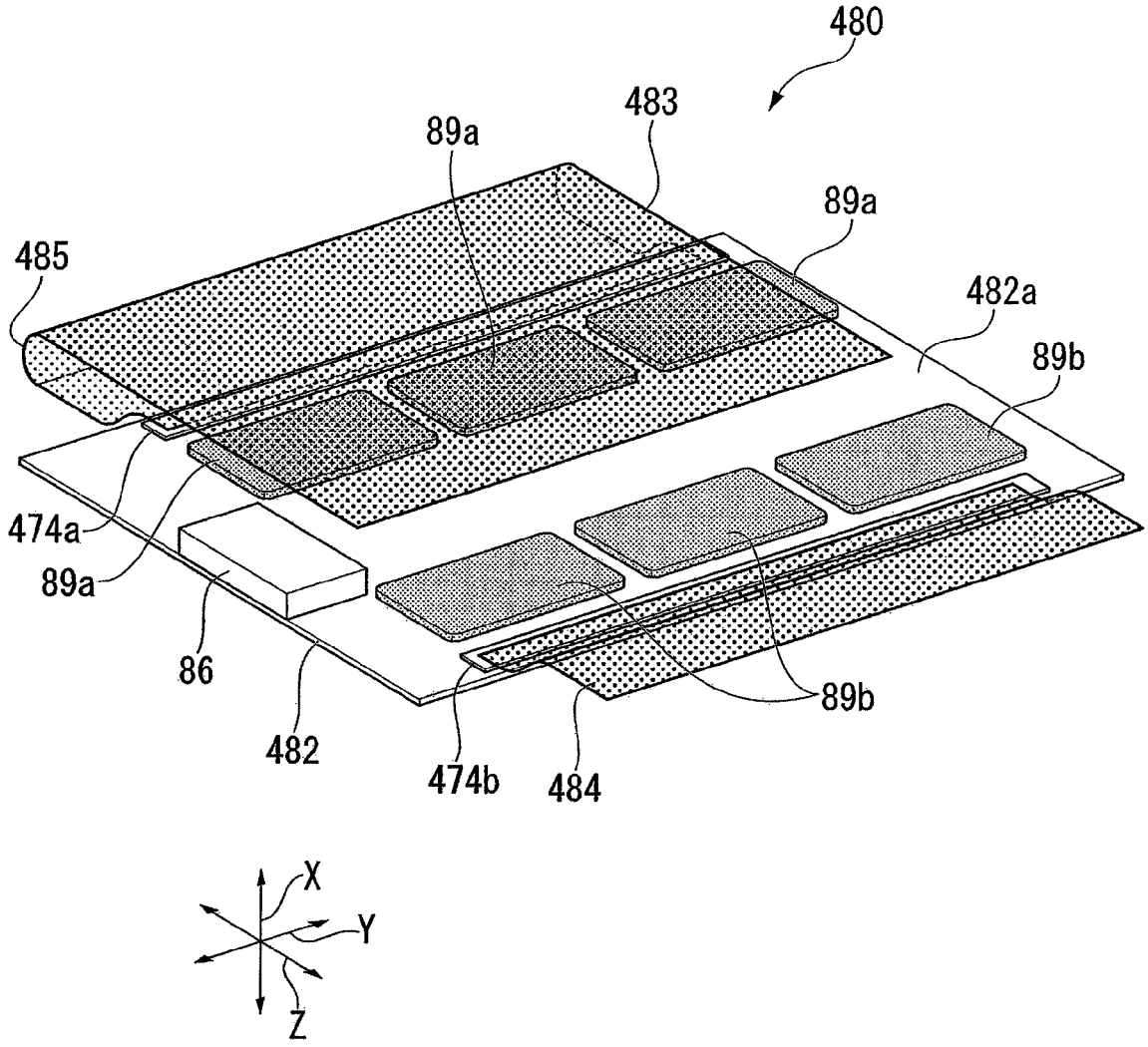
FIG. 7 is a perspective view of a drive control portion in a fourth embodiment of the present invention.

FIG. 7 is a perspective view of a drive control portion in the fourth embodiment.

As illustrated in FIG. 7, a difference between the first embodiment and the fourth embodiment is that the circuit board 82, the first connection board 83, and the second connection board 84 are formed of the single flexible substrate 81 in the drive control portion 80 of the first embodiment, but, on the other hand, a circuit board 482, a first connection board 483, and a second connection board 484 are formed as separate components in a drive control portion 480 of the fourth embodiment. More details will be described below.

(Drive Control Portion)

As illustrated in FIG. 7, the circuit board 482 is formed of an epoxy substrate that is formed into a generally rectangular plate that is long in the Y direction in a plan view. The circuit board 482 is provided with an external device connecting connector 86 which is arranged on a first surface 482*a* thereof on a first side in the longitudinal direction (Y direction).

The circuit board 482 is also provided with a first electrode terminal portion 474*a* for connecting thereto the first connection board 483. The first electrode terminal portion 474*a* is arranged on the first surface 482*a* of the circuit board 482 on a first side in the short side direction (Z direction) (corresponding to "the lateral side" of the circuit board in the claims). The first electrode terminal portion 474*a* has a plurality of electrode terminals that are arranged in a line along the longitudinal direction of the circuit board 482 (Y direction). A first end of the first connection board 483 is connected to the first electrode terminal portion 474*a*.

The circuit board 482 is also provided with a second electrode terminal portion 474*b* for connecting thereto the second connection board 484. The second electrode terminal portion 474*b* is arranged on the first surface 482*a* of the circuit board 482 on a second side in the short side direction (Z direction) (corresponding to "the lateral side" of the circuit board in the claims). The second electrode terminal portion 474*b* also has a plurality of electrode terminals that are arranged in a line along the longitudinal direction of the circuit board 482 (Y direction) in the same manner as in the first electrode terminal portion 474*a*. A first end of the second connection board 484 is connected to the second electrode terminal portion 474*b*.

Each of the first connection board 483 and the second connection board 484 is formed of a flexible substrate that is formed into a band shape.

The first connection board 483 has a bend portion 485 which is set at a position near the connection part to the circuit board 482 throughout the short side direction (Y direction). By bending the first connection board 483 at the bend portion 485, the first connection board 483 and the second connection board 484 are made to extend on the same side in the short side direction of the circuit board 482.

A second end of the first connection board 483 and a second end of the second connection board 484 face each other in the X direction. That is, the direction in which the second end of the first connection board 83 and the second end of the second connection board 484 face each other is the same as the lamination direction of the first head chip 73*a* and the second head chip 73*b*. Although not illustrated in FIG. 7, the first electrode terminal portion 83*a* is provided on the second end of the first connection board 83, and the second electrode terminal portion 84*a* is provided on the second end of the second connection board 484 (see FIG. 3).

Therefore, according to the fourth embodiment, the same effect as that of the first embodiment can be achieved. In addition, by forming the circuit board 482 from an epoxy substrate, it is possible to more easily attach the circuit board 482 to the vertical base 42 than a flexible substrate.

Fifth Embodiment

The fifth embodiment of the present invention will be described on the basis of FIGS. 8A and 8B.

Figure 8A:
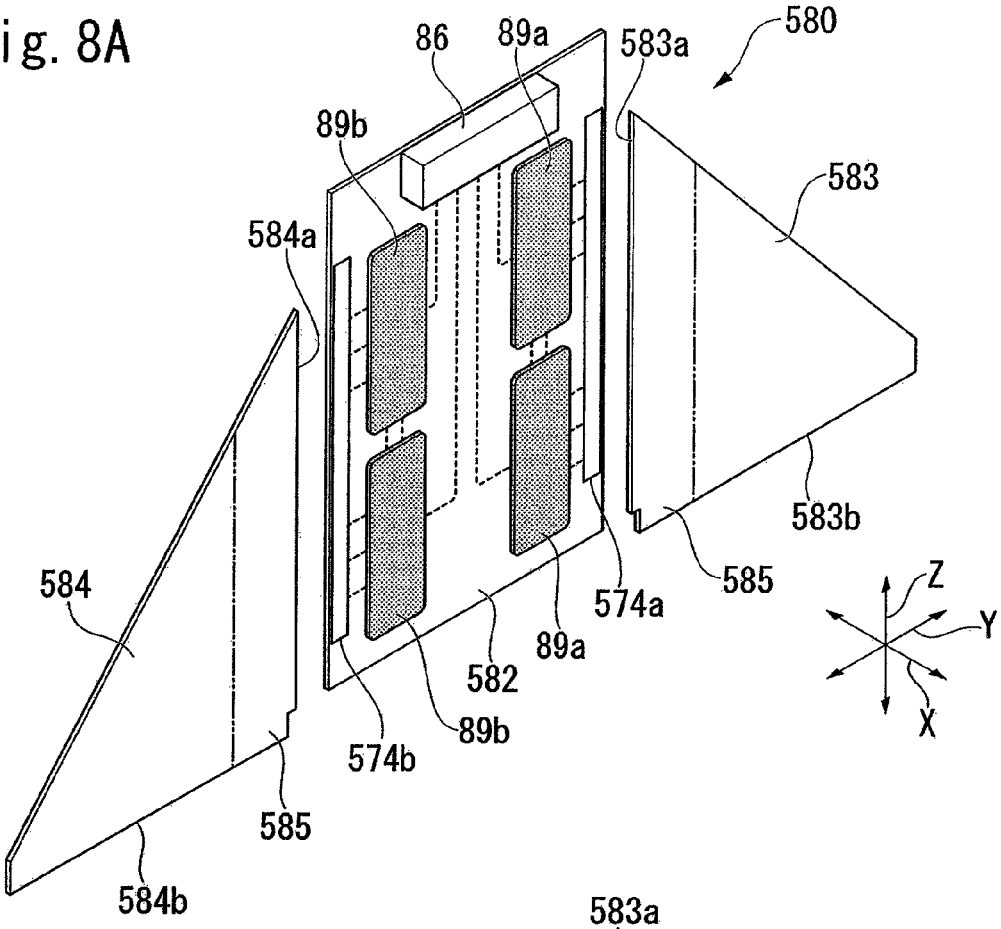
Figure 8B:
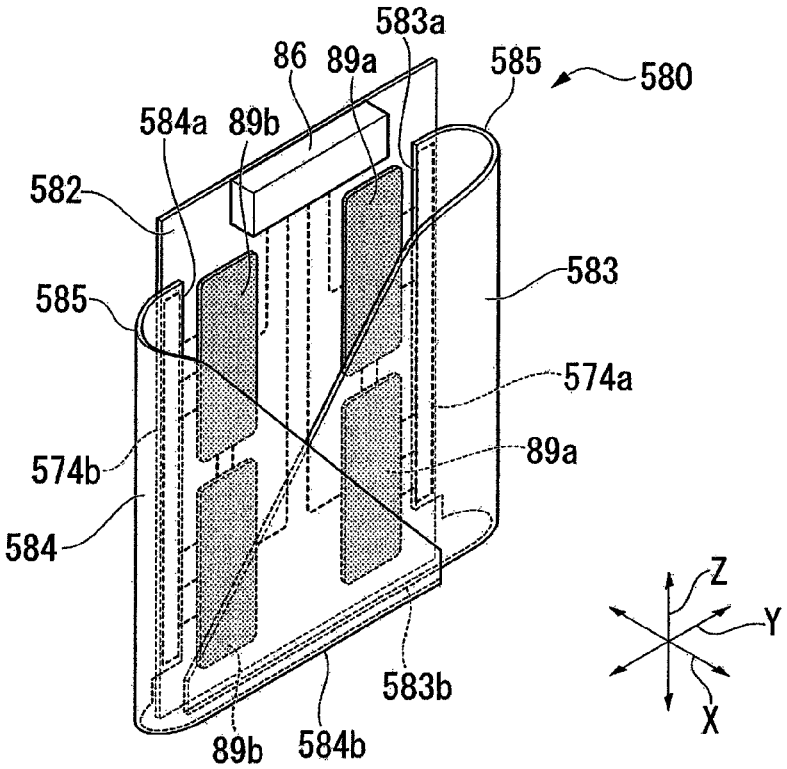

FIGS. 8A and 8B illustrate a drive control portion in the fifth embodiment. FIG. 8A is a development perspective view, and FIG. 8B is a perspective view illustrating the drive control portion when being assembled to an ejecting portion.

As illustrated in FIG. 8A, a difference between the fourth embodiment and the fifth embodiment is that each of the first connection board 483 and the second connection board 484 is formed of a flexible substrate that is formed into a band shape in the drive control portion 480 of the fourth embodiment, but, on the other hand, each of a first connection board 583 and a second connection board 584 is formed of a flexible substrate that is formed into a generally right triangle in a plan view in a drive control portion 580 of the fifth embodiment.

A circuit board 582 is formed into a generally rectangular plate that is long in the Z direction in a plan view. The circuit board 582 includes a first electrode terminal portion 574*a* to which a subtense 583*a* of the first connection board 583 is connected. The circuit board 582 also includes a second electrode terminal portion 574*b* to which a subtense 584*a* of the second connection board 584 is connected.

The first connection board 583 has a bending portion 585 which is set at a position near the connection part to the circuit board 582 throughout the longitudinal direction of the circuit board 582 (Z direction). Also, the second connection board 584 has a bending portion 585 which is set at a position near the connection part to the circuit board 582 throughout the longitudinal direction of the circuit board 582 (Z direction).

As illustrated in FIG. 8B, by bending the first connection board 583 at the bending portion 585 thereof and bending the second connection board 584 at the bending portion 585 thereof, an adjacent side 583*b* of the first connection board 583 and an adjacent side 584*b* of the second connection board 584 are made to overlap with each other in the X direction (the lamination direction of the first head chip 73*a* and the second head chip 73*b*) above the circuit board 582.

That is, by forming each of the first connection board 583 and the second connection board 584 into a generally right triangle in a plan view, one end of the first connection board 583 and one end of the second connection board 584 are connected to the circuit board 582, and the other end of the first connection board 583 and the other end of the second connection board 584 are made to extend on the same side in the longitudinal direction of the circuit board 582 and overlap with each other in the X direction.

Under such a configuration, the adjacent side 583*b* of the first connection board 583 is connected to the electrode extracting portion 74 of the first head chip 73*a* (see FIG. 3). On the other hand, the adjacent side 584*b* of the second connection board 584 is connected to the electrode extracting portion 74 of the second head chip 73*b* (see FIG. 3).

Therefore, according to the fifth embodiment, since the first connection board 583 and the second connection board 584 are made to overlap with each other above the circuit board 582, the drive control portion 580 can be further downsized in addition to the same effect as that of the fourth embodiment.

Sixth Embodiment

The sixth embodiment of the present invention will be described on the basis of FIGS. 9A and 9B.

Figure 9A:
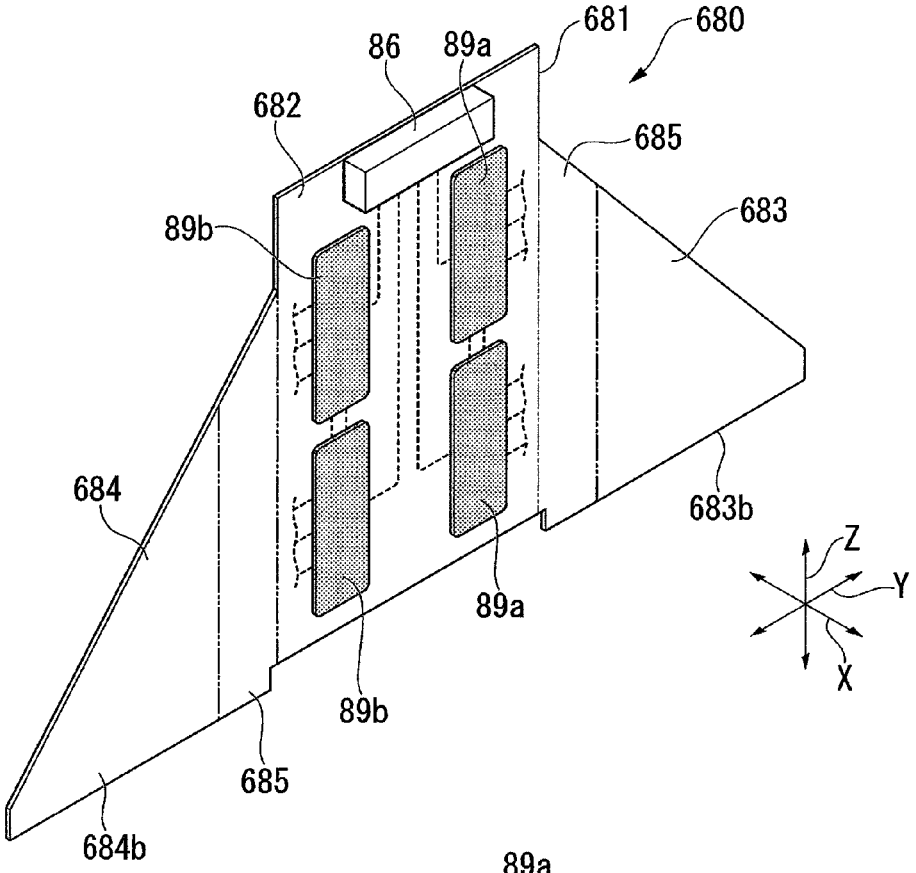
Figure 9B:
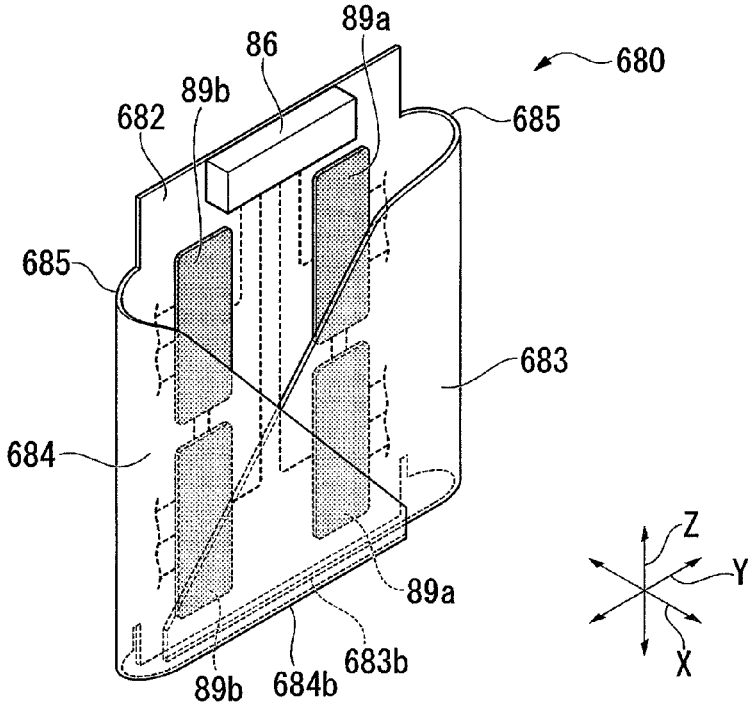
Figure 10:
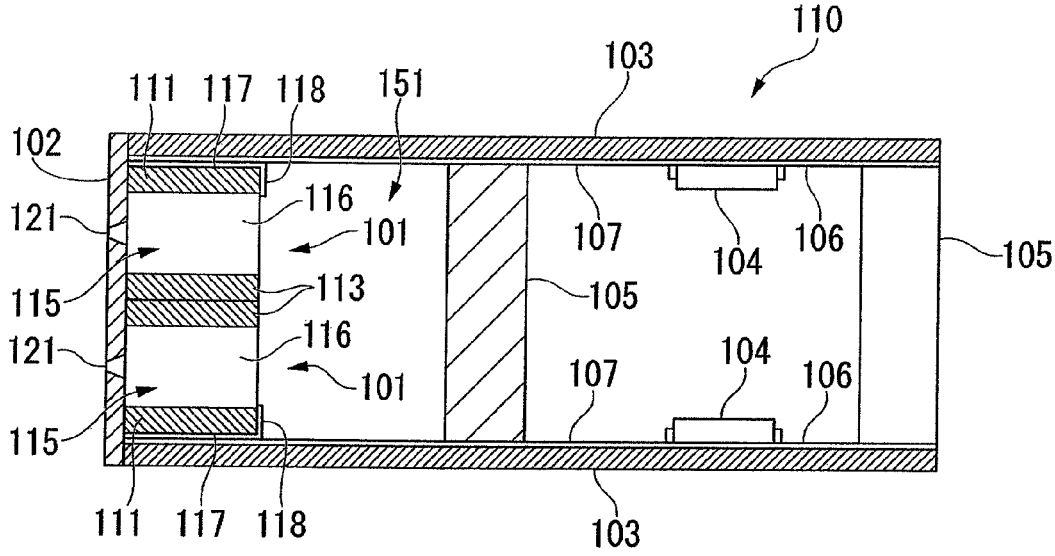
Fig. 10 Prior art
FIG. 10 is a transverse sectional view of an ink jet head of a conventional example.
Figure 11:
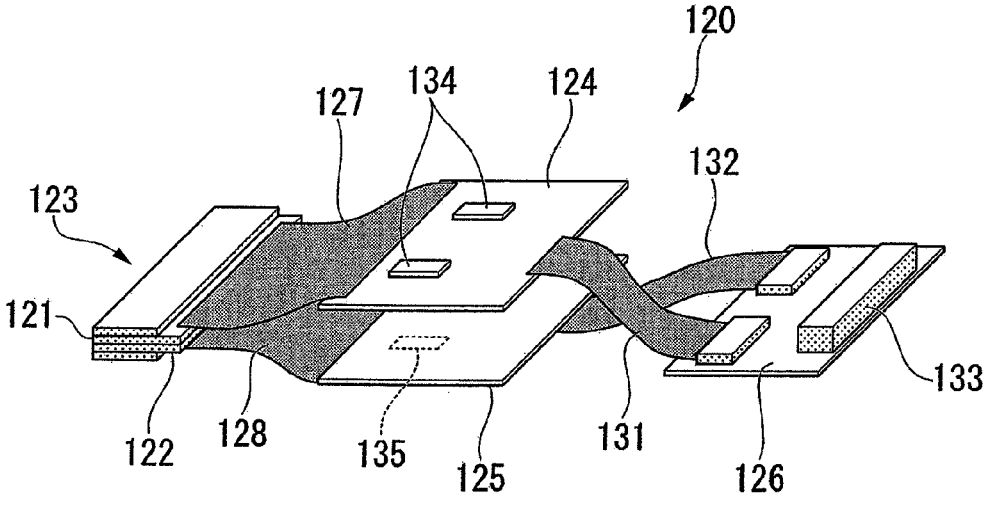
Fig. 11 Prior art
FIG. 11 is a schematic perspective view of a liquid jet head of another conventional example.

FIGS. 9A and 9B illustrate a drive control portion in the sixth embodiment. FIG. 9A is a development perspective view and FIG. 9B is a perspective view illustrating the drive control portion when being assembled to an ejecting portion.

As illustrated in FIG. 9A, a difference between the fifth embodiment and the sixth embodiment is that the circuit board 582, the first connection board 583, and the second connection board 584 are formed as separate components in the drive control portion 580 of the fifth embodiment, but, on the other hand, a drive control portion 680 of the sixth embodiment is formed of a single flexible substrate 681. More details will be described below.

As illustrated in FIG. 9A, the drive control portion 680 includes the single flexible substrate 681 having a generally isosceles trapezoid shape in a plan view. The central part of the flexible substrate 681 is configured as a circuit board 682 having a generally rectangular shape that is long in the Z direction in a plan view. Further, two regions each having a generally right triangle shape in a plan view, the regions extending from the respective sides in the short side direction of the circuit board 682 (Y direction), are configured as a first connection board 683 which is connected to the first head chip 73*a* and a second connection board 684 which is connected to the second head chip 73*b*.

In other words, in the drive control portion 680 of the sixth embodiment, the first connection board 683 and the second connection board 684 are formed on the respective ends in the Y direction of the circuit board 682 so that the circuit board 682, the first connection board 683, and the second connection board 684 are integrated with each other. Although a boundary between the circuit board 682 and the first connection board 683 and a boundary between the circuit board 682 and the second connection board 684 are not particularly clear in FIGS. 9A and 9B, the both ends in the Y direction of the circuit board 682 correspond to "any two lateral sides of the circuit board" in the claims.

Under such a configuration, an adjacent side 683*b* of the first connection board 683 is connected to the electrode extracting portion 74 of the first head chip 73*a* (see FIG. 3). On the other hand, an adjacent side 684*b* of the second connection board 684 is connected to the electrode extracting portion 74 of the second head chip 73*b* (see FIG. 3).

Therefore, according to the sixth embodiment, the same effect as that of the fifth embodiment can be achieved. In addition, since the circuit board 682, the first connection board 683, and the second connection board 684 are formed of the single flexible substrate 681, the number of components can be reduced.

The present invention is not limited to the above embodiments, and includes embodiments obtained by adding various modifications to the above embodiments without departing from the scope of the invention.

For example, in the first, second and third embodiments, there has been described the case in which the circuit board 82 is formed of the flexible substrate 81, and the center in the longitudinal direction thereof (Z direction) is configured as the bend portion 85 throughout the short side direction (Y direction). However, the present invention is not limited thereto. Both side parts across the bend portion 85 of the circuit board 82 may be formed of epoxy substrates, and the two epoxy substrates may be connected to each other through a flexible substrate. Then, the flexible substrate which connects the two epoxy substrates to each other may be configured as the bend portion 85.

In the above embodiments, there has been described the case in which the first connection board 83, 483, 583, or 683 and the second connection board 84, 484, 584, or 684 are separately provided on the respective sides across the circuit board 82, 482, 582, or 682.

However, the present invention is not limited thereto. It is only required that the first connection board 83, 483, 583, or 683 and the second connection board 84, 484, 584, or 684 are separately provided on any two lateral sides of the circuit board 82, 482, 582, or 682. Further, it is only required that, by bending a bend portion that is provided in at least any one of the circuit board 82, 482, 582, or 682, the first connection board 83, 483, 583, or 683, and the second connection board 84, 484, 584, or 684, the first connection board 83, 483, 583, or 683 and the second connection board 84, 484, 584, or 684 are made to extend in the same direction, and the end of the first connection board 83, 483, 583, or 683, the end being connected to the head chip 73*a*, and the end of the second connection board 84, 484, 584, or 684, the end being connected to the head chip 73*b*, face each other in the same direction as the lamination direction of the head chip 73*a* and the head chip 73*b* (X direction).

In the above embodiments, the configuration in which the flexible substrate is bent has been described. In all of the embodiments, the wirings laid on the flexible substrate are connected to the electrode extracting portions 74 illustrated in FIG. 3 formed on the piezoelectric actuator plates PP, and thereby communicate with drive electrodes (not shown) of the piezoelectric actuator plates PP.

Especially in the fourth to seventh embodiments, when the flexible substrate is bent, the electrode extracting portions (electrode terminal portions) of the piezoelectric actuator plates PP and the connection terminals of the flexible substrate may not face with other, and may be located on front and back. In this case, for example, the wirings can be pulled around the front and back of the flexible substrate through a through hole so that the electrode extracting portions (electrode terminal portions) of the piezoelectric actuator plates PP and the connection terminals of the flexible substrate face each other.

For example, in FIG. 8A, when the wirings are laid on the same side in the X direction of the first connection board 583 and the second connection board 584, the wirings on both of the first and second boards 583 and 584 are arranged so as to face the circuit board 582 as illustrated in FIG. 8B. In this case, the electrode extracting portions (electrode terminal portions) of the piezoelectric actuator plates PP and the connection terminals of the flexible substrate do not face each other. Therefore, the wirings are optionally pulled around the front and back of the flexible substrate to solve such a problem.

Further, the two piezoelectric actuator plates PP may not be bonded to each other with their backs facing each other as illustrated in FIG. 3. The two piezoelectric actuator plates PP can face in the same direction in the X direction, and one of the piezoelectric actuator plates PP and one of the cover plates CP, the one being located on the other side in FIG. 3, can be bonded to each other, thereby eliminating the necessity of pulling the wirings around the front and back of the substrate.

Further, in the fifth and sixth embodiments, there has been described the configuration in which the first connection board 583 or 683 and the second connection board 584 or 684 are bent so as to overlap with each other on the same side in the X direction. However, the present invention is not limited thereto. For example, the first connection board 583 or 683 can be bent toward one side in the X direction of the circuit board 582 or 682, and the second connection board 584 or 684 can be bent toward the other side in the X direction of the circuit board 582 or 682.

What is claimed is:

1. A liquid jet head comprising:

an ejecting portion having a first head chip and a second head chip for jetting liquid, the first head chip and the second head chip being laminated with each other;

a circuit board for outputting a drive signal for driving the ejecting portion, the circuit board including an external device connecting terminal portion for electrically connecting the circuit board and an external device to each other, and a window portion for allowing the external device connecting terminal portion to be exposed to the outside;

a first connection board electrically connecting the first head chip and the circuit board to each other; and a second connection board electrically connecting the second head chip and the circuit board to each other, wherein a first end of the first connection board and a first end of the second connection board are separately formed on any two lateral sides of the circuit board, and wherein, by bending at least any one of the circuit board, the first connection board and the second connection board at a bend portion provided in at least any one of the circuit board, the first connection board and the second connection board, a second end of the first connection board and a second end of the second connection board are made to extend in the same direction.

2. The liquid jet head according to claim 1, wherein at least any one of the circuit board, the first connection board and the second connection board is bent at the bend portion.

3. The liquid jet head according to claim 1, wherein the bend portion is provided in the circuit board.

4. The liquid jet head according to claim 1, wherein the circuit board comprises a flexible substrate.

5. The liquid jet head according to claim 1, wherein the bend portion is provided in each of the first connection board and the second connection board.

6. The liquid jet head according to claim 1, wherein each of the first connection board and the second connection board comprises a flexible substrate.

7. The liquid jet head according to claim 1, wherein the circuit board, the first connection board and the second connection board are integrated with each other.

8. The liquid jet head according to claim 1, wherein the second end of the first connection board and the second end of the second connection board face each other in a lamination direction of the first head chip and the second head chip.

9. The liquid jet head according to claim 1, wherein the external device connecting terminal portion comprises a flexible substrate, and the flexible substrate is exposed to the outside through the window portion.

10. The liquid jet head according to claim 1, wherein a wiring on the circuit board is laid so as to avoid the window portion.

11. The liquid jet head according to claim 1, wherein the window portion is formed opposite to the first connection board and the second connection board across respective electronic elements mounted on the circuit board.

12. A liquid jet recording apparatus comprising:
the liquid jet head according to claim 1;
a scanning unit moving the liquid jet head;
a liquid storage body storing therein the liquid; and
a liquid supply pipe laid between the liquid jet head and the liquid storage body, the liquid supply pipe allowing the liquid to circulate therethrough.

* * * * *